US006781552B2

(12) United States Patent
Tsai et al.

(10) Patent No.: US 6,781,552 B2
(45) Date of Patent: Aug. 24, 2004

(54) BUILT-IN MULTI-BAND MOBILE PHONE ANTENNA ASSEMBLY WITH COPLANAR PATCH ANTENNA AND LOOP ANTENNA

(75) Inventors: Tiao-Hsing Tsai, Taipei (TW); Huang-Tse Peng, Hsi-Chih (TW); Kai Shih, Taipei (TW)

(73) Assignee: Quanta Computer Inc., Tao-Yuan Hsien (TW)

( * ) Notice: Subject to any disclaimer, the term of this patent is extended or adjusted under 35 U.S.C. 154(b) by 0 days.

(21) Appl. No.: 10/302,648

(22) Filed: Nov. 22, 2002

(65) Prior Publication Data

US 2004/0100410 A1 May 27, 2004

(51) Int. Cl.[7] ..... H01Q 1/24

(52) U.S. Cl. ..... 343/702; 343/700 MS; 343/725

(58) Field of Search ..... 343/702, 700 MS, 343/725, 726, 728, 729, 833, 834; H01Q 1/24

(56) References Cited

U.S. PATENT DOCUMENTS 5,945,959 A * 8/1999 Tanidokoro et al. ..... 343/728
6,392,610 B1 * 5/2002 Braun et al. ..... 343/876
6,518,929 B1 * 2/2003 Gilmore ..... 343/725

* cited by examiner

*Primary Examiner*—Hoanganh Le
(74) *Attorney, Agent, or Firm*—Ladas & Parry

(57) ABSTRACT

A built-in multi-band mobile phone antenna assembly includes a patch antenna, a loop antenna disposed adjacent to the patch antenna, and a parasitic element disposed adjacent to both the patch antenna and the loop antenna and coupled parasitically to the patch antenna.

6 Claims, 1 Drawing Sheet

BUILT-IN MULTI-BAND MOBILE PHONE ANTENNA ASSEMBLY WITH COPLANAR PATCH ANTENNA AND LOOP ANTENNA

BACKGROUNDING OF THE INVENTION

1. Field of the Invention

This invention relates to a mobile phone antenna, and more particularly to a multi-band mobile phone antenna assembly, which can increase effectively the bandwidth of the antenna.

2. Description of the Related Art

Recent mobile phones tend to have a compact size and an attractive appearance. Therefore, built-in type antennas, which are concealed within mobile phones, have developed rapidly. For example, referring to FIG. 1, a conventional planar inverted F-shaped antenna (PIFA) 1 is shown to include a metal strip, which is formed with a slot 10 that has an open end 101 and a closed end 102 and which includes a first antenna portion 11, a second antenna portion 12, a signal feeding point 13 disposed between the first and second antenna portions 11, 12, and a grounding point 14 disposed adjacent to the signal feeding point 13. The first antenna portion 11 is a low frequency antenna, and is applicable in a GSM 900 system. The second antenna portion 12 is a high frequency antenna, and is applicable in a DCS1800 system. The signal feeding point 13 and the grounding point 14 are in electrical connection with a circuit board (not shown) in a mobile phone. The bandwidth and gain of the antenna 1 are proportional to the size of the antenna 1 and the distance between the antenna 1 and the ground. The size of the conventional PIFA is too small to have a wide bandwidth.

To overcome this problem, referring to FIG. 2, a parasitic element 2 can be coupled parasitically to the second antenna portion 12 so as to increase the resonant frequency of the latter. As such, the second antenna portion 12 is applicable in both DCS1800 and PCS1900 systems. However, the bandwidth of the conventional PIFA 1 is widened only within the high frequency band of the second antenna portion 12 but not within the low frequency band of the first antenna portion 11.

SUMMARY OF THE INVENTION

The object of this invention is to provide a built-in multi-band mobile phone antenna, which can reduce influence on antenna gain due to distance between the antenna and the ground, and which can increase the bandwidths of both high and low frequency bands.

According to this invention, a built-in multi-band mobile phone antenna assembly includes a patch antenna, a loop antenna disposed adjacent to the patch antenna, and a parasitic element disposed adjacent to both the patch antenna and the loop antenna and coupled parasitically to the patch antenna. As such, the influence of the distance between the antenna and the ground is reduced with respect to the antenna gain, and the bandwidth of the antenna is widened.

The patch antenna serves as a low frequency antenna. The loop antenna serves as a high frequency antenna. The bandwidths of the patch and loop antennas are widened.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
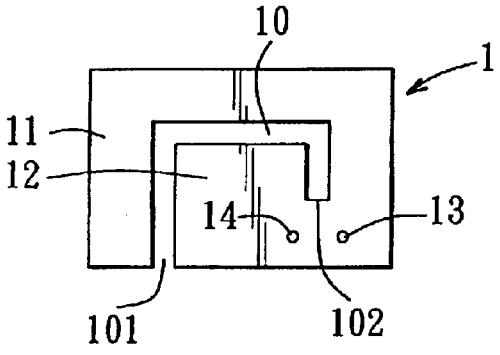
FIG. 1 PRIOR ART
FIG. 1 illustrates a conventional PIFA.
Figure 2:
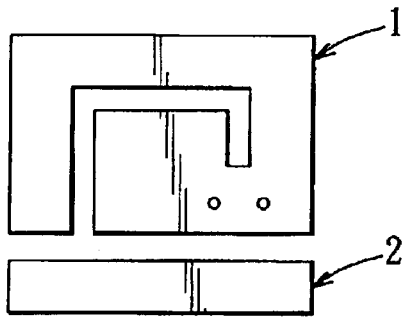
FIG. 2 PRIOR ART
FIG. 2 illustrates another conventional PIFA modified from that of FIG. 1.
Figure 3:
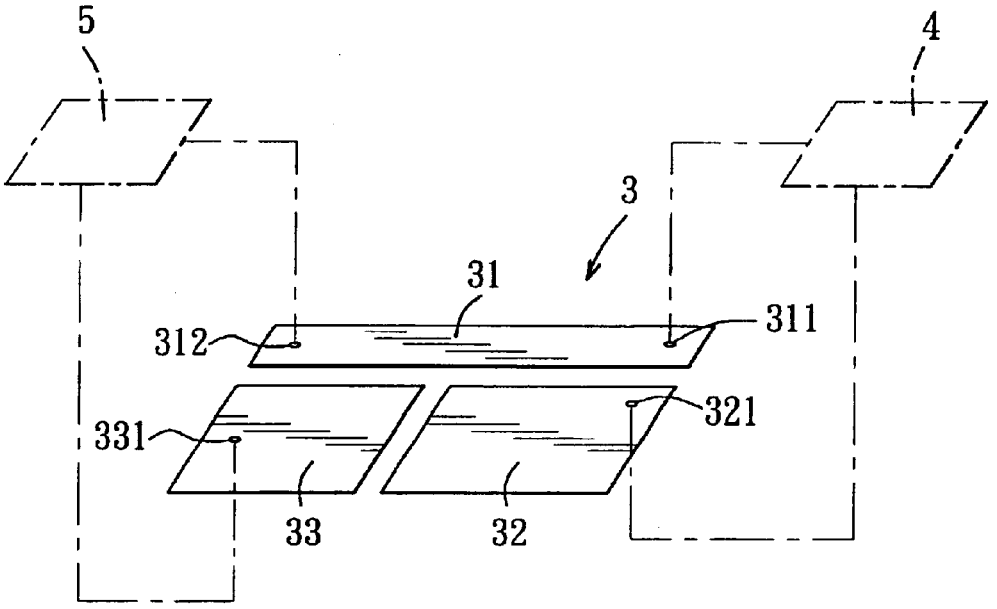
FIG. 3 illustrates the preferred embodiment of a built-in multi-band mobile phone antenna assembly according to this invention.

Referring to FIG. 3, the preferred embodiment of a built-in multi-band mobile phone antenna assembly 3 is shown to include an elongated planar loop antenna 31, a patch antenna 32, and a parasitic element 33, which is coplanar with the planar loop antenna 31 and the patch antenna 32.

The planar loop antenna 31 serves as a high frequency antenna, i.e. half-wave antenna, is applicable in DCS1800 and pcs1900 systems, and has a signal feeding point 311 and a grounding point 312, which are disposed respectively at two opposite ends of the planar loop antenna 31 and which are respectively in electrical connection with a circuit board 4 and a grounding plane 5 that are installed within a mobile phone (not shown).

The patch antenna 32 is disposed adjacent to the planar loop antenna 31, serves as a lower frequency antenna, i.e. quarter-wave antenna, is applicable in a GSM900 system, and has a signal feeding point 321 that is in electrical connection with the circuit board 4 in the mobile phone. Because the patch antenna 32 has a size and a shape so as to operate over a quarter-wave frequency band, the influence on the antenna gain due to the distance between the patch antenna 32 and the ground can be reduced.

The parasitic element 33 is configured as a rectangular flat metal plate, is disposed adjacent to the planar loop antenna 31 and the patch antenna 32, is coupled parasitically to the patch antenna 32 so as to increase the bandwidth of the patch antenna 32, and has a grounding point 331 that is in electrical connection with the grounding plane 5 in the mobile phone.

With this invention thus explained, it is apparent that numerous modifications and variations can be made without departing from the scope and spirit of this invention. It is therefore intended that this invention be limited only as indicated by the appended claims.

We claim:

1. A built-in multi-band mobile phone antenna assembly adapted to be disposed within a mobile phone that is provided with a circuit board and a grounding plane therein, said antenna assembly comprising:

a patch antenna;

a planar loop antenna disposed adjacent to said patch antenna; and a parasitic element disposed adjacent to both said patch antenna and said loop antenna and coupled parasitically to said patch antenna.

2. The built-in multi-band mobile phone antenna assembly as claimed in claim 1, wherein said planar loop antenna is provided with a signal feeding point and a grounding point thereon, which are adapted to be coupled respectively and electrically to the circuit board and the grounding plane.

3. The built-in multi-band mobile phone antenna assembly as claimed in claim 1, wherein said patch antenna is provided with a signal feeding point thereon, which is adapted to be coupled electrically to the circuit board.

4. The built-in multi-band mobile phone antenna assembly as claimed in claim 1, wherein said parasitic element is provided with a grounding point thereon, which is adapted to be coupled electrically to the grounding plane.

5. The built-in multi-band mobile phone antenna assembly as claimed in claim 1, wherein said patch antenna is applicable in GSM900 system, and said loop antenna is applicable in DCS 1800 and PCS 1900 systems.

6. The built-in multi-band mobile phone antenna assembly as claimed in claim 1, wherein said parasitic element is coplanar with said patch antenna and said loop antenna.

* * * * *